US005679063A

United States Patent [19]

Kimura et al.

[11] Patent Number: 5,679,063

[45] Date of Patent: Oct. 21, 1997

[54] POLISHING APPARATUS

[75] Inventors: Norio Kimura; You Ishii; Hozumi Yasuda, all of Fujisawa; Koji Saito, Yamato; Masako Watase, Yokohama; Shiro Mishima, Yokkaichi, all of Japan

[73] Assignees: Ebara Corporation, Tokyo; Kabushiki Kaisha Toshiba, Kawasaki, both of Japan

[21] Appl. No.: 590,477

[22] Filed: Jan. 24, 1996

[30] Foreign Application Priority Data

Jan. 24, 1995 [JP] Japan ..... 7-027630

[51] Int. Cl.[6] ..... B24B 7/00

[52] U.S. Cl. ..... 451/287; 451/60; 451/446

[58] Field of Search ..... 451/287, 288, 451/289, 290, 446, 60, 41, 450, 285, 286

[56] References Cited

U.S. PATENT DOCUMENTS 3,979,239 9/1976 Walsh ..... 156/636.1
4,059,929 11/1977 Bishop ..... 451/446
5,478,435 12/1995 Murphy et al. ..... 156/636.1
5,584,749 12/1996 Mitsuhashi et al. ..... 451/41

FOREIGN PATENT DOCUMENTS 2024054 1/1990 Japan ..... 451/450
4135163 5/1992 Japan ..... 451/41

*Primary Examiner*—Robert A. Rose
*Attorney, Agent, or Firm*—Wenderoth, Lind & Ponack

[57] ABSTRACT

A polishing apparatus for polishing a surface of an object such as a semiconductor wafer includes a turntable having a polishing cloth mounted on an upper surface thereof, a top ring for holding and pressing the object against the polishing cloth, and a plurality of radially arranged nozzles for supplying a polishing solution, containing abrasive material, of different concentrations that differ along a radial direction of the polishing cloth.

14 Claims, 5 Drawing Sheets

POLISHING APPARATUS

BACKGROUND OF THE INVENTION

1. Field of the Invention

The present invention relates in general to a polishing apparatus, and more particularly to a polishing apparatus for producing a flat mirror polished surface on an object such as a semiconductor wafer.

2. Description of the Related Art

High density integrated semiconductor devices of recent years require increasingly finer microcircuits, and the interline spacing also has been a steadily decreased. For optical lithography operations based on less than 0.5 micrometer interline spacing, the depth of focus is shallow and high precision in flatness is required on the polished object, which depth of focus has to be coincident with the focusing plane of the stepper.

Therefore, it is necessary to make the surface of a semiconductor wafer flat before fine circuit interconnections are formed thereon. According to one customary process, semiconductor wafers are polished to a flat finish by a polishing apparatus.

One conventional polishing apparatus comprises a turntable with a polishing cloth attached to its upper surface and a top ring disposed in confronting relationship to the upper surface of the turntable, the turntable and the top ring being rotatable at respective independent speeds. The top ring is pressed against the turntable to impart a certain pressure to an object which is interposed between the polishing cloth and the top ring. While a polishing solution containing abrasive material is supplied onto the upper surface of the polishing cloth, the surface of the object is polished to a flat mirror finish by the polishing cloth which has the polishing solution thereon, during relative rotation of the top ring and the turntable.

However, material removal by such a process does not always occur uniformly across the polished surface of a wafer, despite the effort to provide a uniform material removal.

Some examples of typical cases of uneven surface contour which occur in polished wafers are illustrated in FIGS. 7A, 7B and 7C. Such unevenness is caused by differences in the local rates of material removal from a the wafer, for example, the wafer shown in FIG. 7A has more material removed from the center than the outer peripheral part, the wafer shown in FIG. 7B has more material removed from the center and the outer peripheral part than the intermediate part, and the wafer shown in FIG. 7C has more material removed from the outer peripheral part than the center.

Some of the reasons for causing such uneven material removal may be uneven wear of the polishing cloth, non-uniform pressing pressure over the entire surface of the wafer exerted by the top ring, and non-uniform distribution of the polishing solution containing abrasive material over the entire surface of the wafer, caused by non-uniform retention of the polishing solution by the cloth or non-uniform supply of the polishing solution onto the cloth.

SUMMARY OF THE INVENTION

It is an object of the present invention to provide a polishing apparatus which can produce uniform polishing action across the polished surface of an object such as a semiconductor wafer so as to achieve a uniformly flat and mirror polished finish on the object.

Such object is achieved according to the invention by providing a polishing apparatus for polishing a surface of an object and including a turntable having a polishing cloth mounted on an upper surface thereof, a top ring for holding and pressing the object against the polishing cloth, and a plurality of radially arranged nozzles for supplying a polishing solution, containing abrasive material, of different concentrations differing along a radial direction of the polishing cloth.

According to a first aspect of the present invention, polishing solutions of different concentrations are supplied through the radially arranged nozzles disposed above the polishing cloth. Therefore, the apparatus allows fine tuning of the rate of removal of the surface material of the object by adjusting the concentrations of the polishing solution at respective of the nozzles. The concentration of the polishing solution can be lowered in an area where the removal rate is high while the concentration of the polishing solution can be raised in an area where the removal rate is low. By providing an optimum distribution of concentrations of the polishing solution along a radial direction, it is possible to improve the flatness of the wafer significantly.

According to another aspect of the present invention, there is provided a polishing apparatus for polishing a surface of an object and including a turntable having a polishing cloth mounted on an upper surface thereof, a top ring for holding and pressing the object against the polishing cloth, at least one solution nozzle for supplying a polishing solution, containing abrasive material, having a common concentration, and a plurality of diluting liquid supply nozzles arranged in a radial direction for supplying adjustable volumes of diluting liquid so as to form a distribution of polishing solution of different concentrations by diluting the polishing solution with the diluting liquid on the polishing cloth.

According to this configuration, one supply nozzle for a polishing solution with a common concentration may be utilized together with a several diluting liquid nozzles for supplying adjustable volumes of diluting liquid. The polishing solution with a common concentration can be diluted by the diluting liquid so that an optimum distribution of concentrations of the polishing solution along a radial direction can be produced, thereby making it possible to improve the flatness of the wafer significantly.

According to still another aspect of the present invention, there is provided a polishing apparatus for polishing a surface of an object and including a turntable having a polishing cloth mounted on an upper surface thereof, a top ring for holding and pressing the object against the polishing cloth, at least one solution nozzle for supplying a polishing solution containing abrasive material, and at least one supply nozzle for supplying water containing a dispersion agent so as to form a distribution of polishing solution of different concentrations by diluting the polishing solution with the water containing the dispersion agent on the polishing cloth.

According to this configuration, one supply nozzle for a polishing solution with a certain concentration can be utilized together with supply nozzles for supplying water containing a dispersion agent. With this arrangement, a polishing solution and a dispersion agent can be supplied onto the polishing cloth to be mixed, thus obtaining desired concentrations of the dispersion agent and the polishing solution. There is a correlation between the concentration of the dispersion agent in the polishing solution and the polishing rate. That is, high concentration of the dispersion agent causes a low rate of material removal while low concentration of the dispersion agent causes a high rate of material removal. Thus, the polishing action can be adjusted to improve the flatness of the object such as a semiconductor wafer in the same manner as above. However, if the concentration of the dispersion agent is very high, there is no need to provide several radially arranged nozzles because a flat surface can be fairly readily produced with a lesser number of nozzles.

DESCRIPTION OF THE PREFERRED EMBODIMENTS

Preferred embodiments will be explained in the following with reference to FIGS. 1 to 8.

Figure 1:
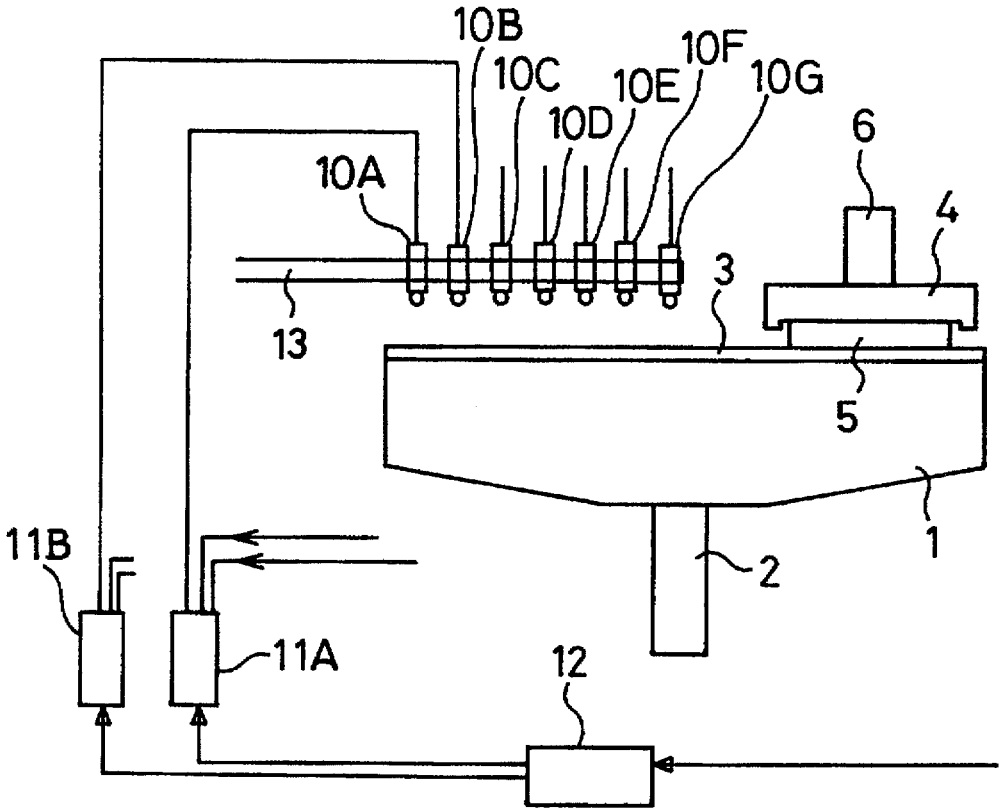
FIG. 1 is a side view of a first embodiment of the polishing apparatus of the present invention.
Figure 2:
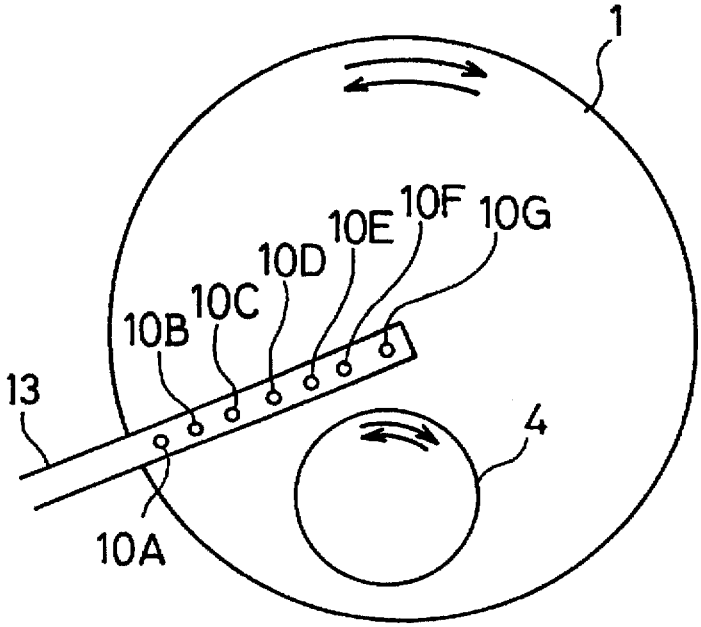
FIG. 2 is a top view of a turntable and associated supply nozzles of the first embodiment.

FIG. 1 shows a side view of a first embodiment of the polishing apparatus. The polishing apparatus has a turntable 1 with a polishing cloth 3 mounted thereon, and a top ring 4 disposed above the turntable 1. The turntable 1 is rotatable about a shaft 2. The top ring 4 is coupled to a driving shaft 6, and, as shown in FIG. 2, its center of rotation is displaced from the center of rotation of the turntable 1. The turntable 1 and the top ring 4 can be rotated in either direction shown by arrows in FIG. 2. A top ring cylinder (not shown) is attached to the upper portion of the drive shaft 6 so as to press the top ring 4 against the turntable 1, whereby a lower surface of a semiconductor wafer 5 held by the top ring 4 faces the polishing cloth 3 and is pressed down onto the polishing cloth 3 at a certain pressure.

Above the turntable 1, supply nozzles 10A, 10B . . . 10G are located to supply a polishing solution containing abrasive material onto the surface of the polishing cloth 3 mounted on the turntable 1. As shown in FIG. 2, a nozzle support 13 is disposed in a radial direction of the turntable 1 so that the supply nozzles 10A, 10B . . . 10G are arranged in the radial direction. Each of the supply nozzles 10A, 10B . . . 10G is operatively connected to each of solution mixing units 11A, 11B . . . so that a polishing solution of a specific concentration can be supplied onto the polishing cloth 3 from each of the supply nozzles 10A, 10B . . . 10G. In the solution mixing units 11A, 11B . . . , polishing solutions containing abrasive material and a diluting liquid such as deionized water are supplied and mixed to produce a specific concentration of polishing solution therein. A control unit 12 adjusts the concentration of the polishing solution according to polishing data in each of the solution mixing units 11A, 11B, . . . Here, the polishing solution may utilize silica group or cerium oxide ($CeO_2$) group materials.

Figure 7A:
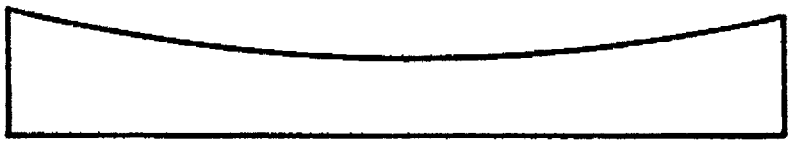
FIG. 7A is a sectional view of a first example of a polished semiconductor wafer.
Figure 7B:
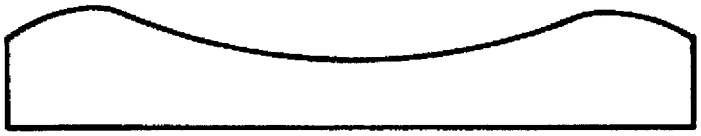
FIG. 7B is a sectional view of a second example of a polished semiconductor wafer.
Figure 7C:
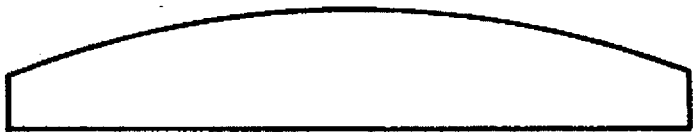
FIG. 7C is a sectional view of a third example of a polished semiconductor wafer.

Because polishing of the wafer 5 is carried out by rotating the wafer 5 about its center of rotation, the examples of non-uniform polishing results shown in FIGS. 7A–7C show that unevenness in the surface contour is also produced symmetrically with respect to such a center of rotation. It then follows that, to correct the non-uniformity in flatness on the polished surface, it is required to equalize the material removal rate in local regions of the wafer disposed symmetrically about a line passing through the center of rotation of the wafer, by supplying polishing solutions of the same concentration from nozzles located at the same distance from the center of rotation of the wafer. For example, if the center of rotation of the wafer is coincident with the nozzle 10D, each of the pairs of nozzles 10C and 10E, 10B and 10F, and 10A and 10G should be supplied from a separate solution mixing units 11A, 11B and 11C containing solutions of respective different concentrations. By adopting such an arrangement, it would be possible to reduce the number of solution mixing units required to maintain a constant rate of material removal at all locations of the wafer.

The operation of the polishing apparatus having such a nozzle configuration will be explained. First, a wafer (polished object) 5 is held by the top ring 4 under vacuum suction, and the wafer 5 is pressed against the polishing cloth 3 mounted on the rotating turntable 1 by means of the top ring cylinder.

In the meanwhile, polishing solutions having respective specific concentrations are supplied through the nozzles 10A, 10B, 10C . . . so that the polishing solution having different concentrations in a radial direction can be retained on the polishing cloth. The polishing is performed in such a state that the polishing solution is present between the polished cloth 3 and the polishing surface (which is the lower surface of the wafer 5).

Figure 5:
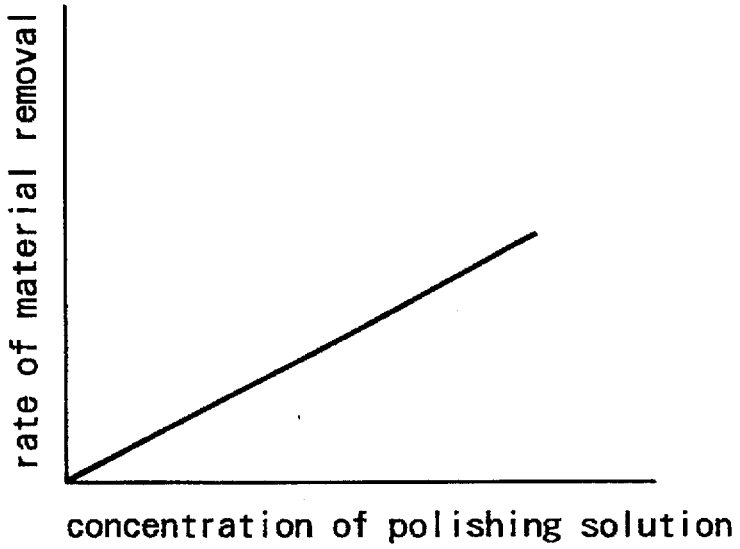
FIG. 5 is a graph showing the relationship between the concentration of a polishing solution and the rate of material removal.

FIG. 5 is a graph showing the relationship between the concentration of the polishing solution and the rate of material removal. As shown in this graph, the rate of material removal varies linearly with the concentration of the polishing solution. It follows that, by raising the concentration of the polishing solution, it is possible to increase the rate of material removal while, by lowering the concentration of the polishing solution, it is possible to decrease the rate of material removal.

Figure 6:
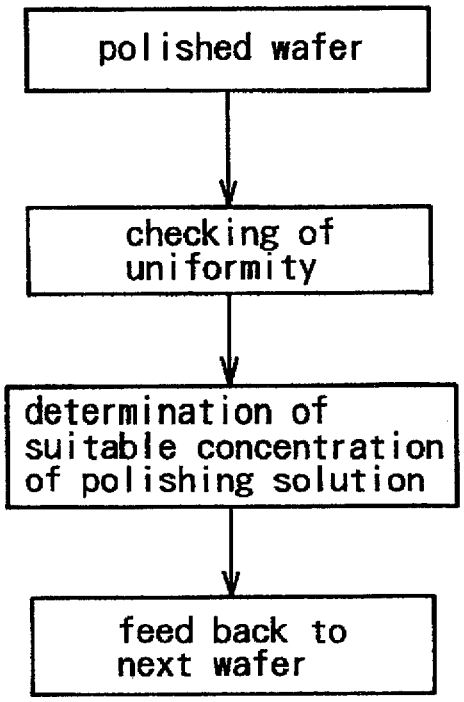
FIG. 6 is a flowchart of the polishing process for the present polishing apparatus.

FIG. 6 shows a flowchart showing the steps for determining the required solution concentration. First, a polished wafer is examined as a first wafer, and the uniformity of material removal across the wafer is checked. The checking process is carried out by measuring the amount of material removed, along a radial direction, because unevenness of the surface contour occurs symmetrically along any diameter line. When non-uniformity in flatness is found, the solution mixing unit connected to the nozzles, corresponding to the locations of unevenness of the surface contour, is adjusted to obtain a suitable concentration of the polishing solution.

For example, if the rate of material removal is high in the center as shown in FIG. 7A, the concentration of the polishing solution for the nozzle 10D is lowered to decrease the polishing rate. In the remaining locations which suffer from low rate of material removal, the concentrations of the polishing solution for the pairs of nozzles 10A, 10G and 10B, 10F are raised. Such adjustments in solution concentrations are carried out along each of the nozzles as required so that the polishing process will produce a uniformly flat surface across the entire area of the wafer. The adjustments to each of the solution mixing units 11A, 11B . . . are entered through the controller 12. A second wafer is mounted on the top ring 4 to perform a second polishing operation. It is possible to adjust the solution concentration manually without using a controller.

Figure 3:
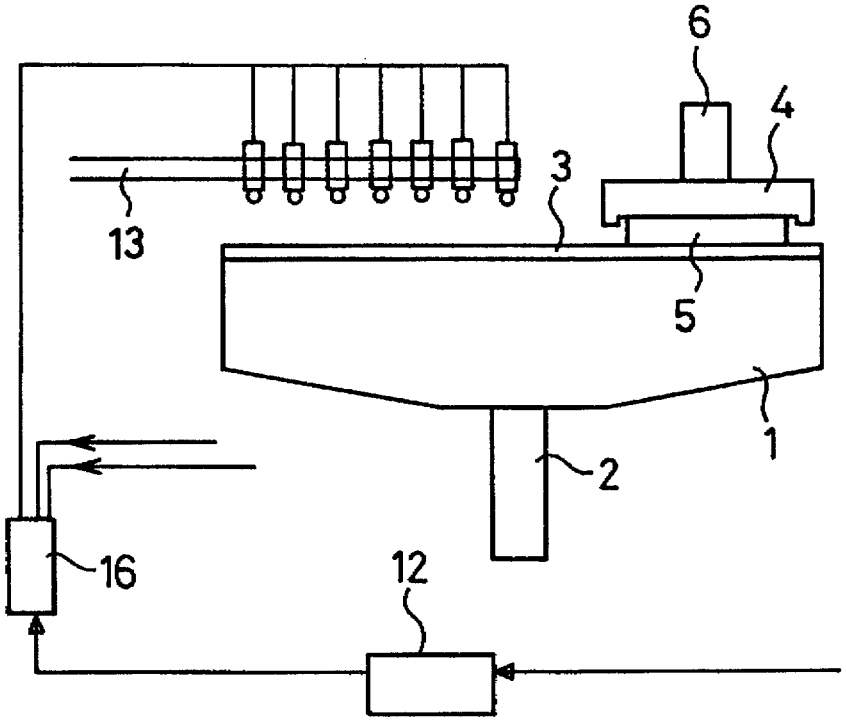
FIG. 3 is a side view of a second embodiment of the polishing apparatus of the present invention.
Figure 4:
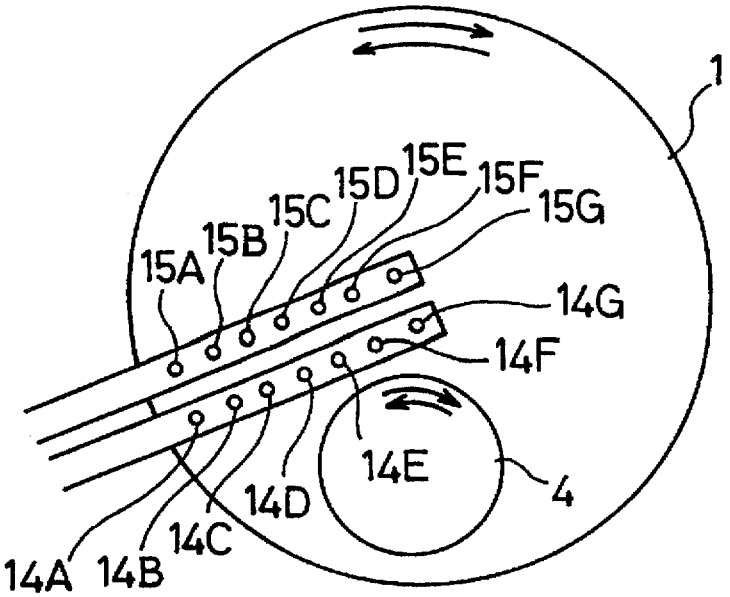
FIG. 4 is a top view of the turntable and associated supply nozzles of the second embodiment.

FIGS. 3 and 4 show another embodiment of the polishing apparatus, and correspond to the views shown in FIGS. 1 and 2. Those parts of the apparatus which are the same as those in the first embodiment are referred to by the same reference numerals, and description thereof is omitted.

The apparatus of the second embodiment is provided with radially arranged solution supply nozzles 14A, 14B . . . 14G and water supply nozzles 15A, 15B . . . 15G. The solution supply nozzles 14A, 14B . . . 14G are operatively connected to a common polishing solution mixing unit 16, and the polishing solutions from all of the nozzles have the same concentration. Each of the water supply nozzles 15A, 15B . . . 15G is provided with a needle valve so that the volume of water supplied therefrom can be adjusted. By adjusting the volume of water delivered in the radial direction through each of the water supply nozzles 15A, 15B . . . 15G, it is possible to maintain a desired degree of dilution of the polishing solution on the polishing cloth. As a result, a desired type of radial distribution of concentration of the polishing solution can be produced, thereby making it possible to adjust the amount of material removal, even when the mechanical pressing pressure exerted by the top ring 4 may be non-uniform, and producing a wafer which is uniformly polished over the entire surface of the wafer.

In this type of nozzle arrangement, because there is no need for providing a solution mixing unit for each of nozzles, it is possible to simplify the construction of the polishing apparatus significantly. Also, because the concentration of the polishing solution supplied from one mixing unit is the same for all nozzles, there is no particular need to provide many nozzles as illustrated in the drawing. If appropriate, only a few nozzles may be provided. Or, only one nozzle, as in the conventional polishing apparatus, may be provided.

Figure 8:
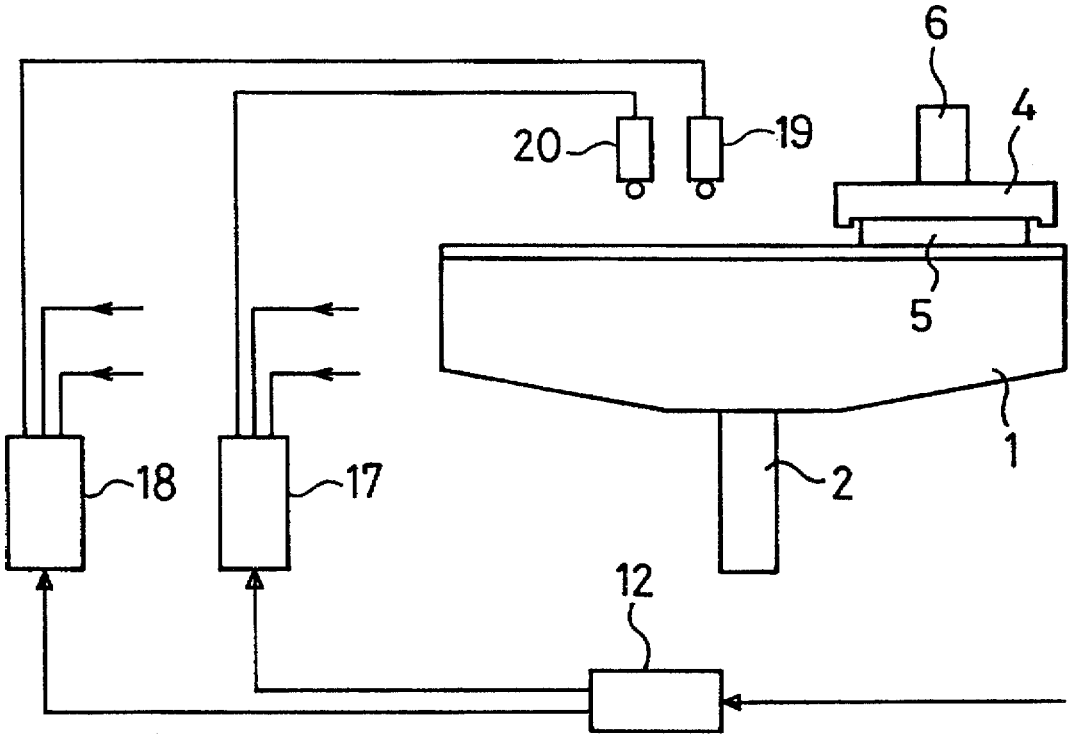
FIG. 8 is a side view of a third embodiment of the present polishing apparatus.

FIG. 8 shows a third embodiment of the apparatus, and corresponds to the views shown in FIGS. 1 and 3. In FIG. 8, the same reference numerals are used for the same parts used in FIGS. 1 and 3, and description thereof is omitted.

The apparatus is provided with a solution supply nozzle 19 for supplying solution supplied from a solution mixing unit 18, and a water supply nozzle 20 for supplying water containing a dispersion agent supplied from a dispersion agent mixing unit 17. In the dispersion agent mixing unit 17, any desired mixing ratio of a dispersion agent and water may be produced. Both the solution supply nozzle 19 and the water supply nozzle 20 are equipped with respective needle valves to enable adjustment of the supply volume. Therefore, by adjusting the degree of opening of the needle valve appropriately, the dispersion agent or polishing solution can be diluted to any desired concentration, and desired concentrations of the dispersion agent and the polishing solution can be retained on the polishing cloth. When the concentration of the dispersion agent is high, a uniformly polished wafer may be obtained using only two nozzles as illustrated in FIG. 8. Also, handling of the polishing solution is easier when the water containing the dispersion agent is combined with the polishing solution on the polishing cloth rather than pre-mixing the two liquids in a mixing unit. This is because when the concentration of the dispersion agent is made higher than that in normal usage to obtain uniform distribution of concentration of the dispersion agent on the polishing cloth, there is a tendency for the abrasive material to precipitate out and settle in the mixing unit.

In this embodiment, only two nozzles are illustrated, but it is permissible to provide several nozzles as in the case of embodiment shown in FIGS. 3 and 4. Especially, when the concentration of dispersion agent is low, it is better to provide several radially arranged nozzles. The optimum number of nozzles is different for different types of dispersion agents.

To summarize the effects of the polishing apparatus disclosed, flatness across the entire surface of a wafer is improved notably by properly adjusting polishing operations along the radial direction on the polishing cloth to achieve a uniform pattern of material removal suitable to a particular set of polishing conditions.

In the first and second embodiments, there are seven radially arranged nozzles, but the number of nozzles may be ten or five. It should be noted that a higher number of nozzles permits finer adjustments in surface flatness, but the apparatus becomes correspondingly complex.

Also, a semiconductor wafer was used as an example of the polished object, but it is obvious that the apparatus is applicable to any type of object requiring planar or mirror polishing, such as electronic parts.

In the above embodiments, although a plurality of radially arranged nozzles for supplying a polishing solution of different concentrations are provided, such a plurality of nozzles may supply a polishing solution of different composition of components. For example, one of nozzles can supply a polishing solution containing A component and B component, and the remaining nozzles can supply a polishing solution containing A component, B component and C component.

Further, in the above embodiments, an object such as a semiconductor wafer is polished to a flat mirror finish using the specific structure of the present invention. However, the specific structure of the present invention offers such advantages that desired localized areas of the surface of the object can be polished to different degrees.

It is clear to those skilled in the art that various modifications and applications are possible without departing from the concept disclosed that unevenness of the surface contour are correctable by finely adjusting the polishing operations.

What is claimed is:

1. A polishing apparatus for polishing a surface of an object, said apparatus comprising:

a turntable having a polishing cloth mounted on an upper surface thereof;

a top ring for holding and pressing the object against said polishing cloth; and a plurality of radially arranged nozzles for supplying a polishing solution, containing abrasive material, of different concentrations differing along a radial direction of said polishing cloth.

2. A polishing apparatus for polishing a surface of an object, said apparatus comprising:

a turntable having a polishing cloth mounted on an upper surface thereof;

a top ring for holding and pressing the object against said polishing cloth;

at least one solution nozzle for supplying a polishing solution, containing abrasive material, having a common concentration; and a plurality of diluting liquid supply nozzles arranged in a radial direction for supplying adjustable volumes of diluting liquid so as to form a distribution of polishing solution of different concentrations by diluting said polishing solution with said diluting liquid on said polishing cloth.

3. A polishing apparatus as claimed in claim 2, wherein said diluting liquid comprises water.

4. A polishing apparatus for polishing a surface of an object, said apparatus comprising:

a turntable having a polishing surface;

a top ring for holding and pressing the object against said polishing surface;

at least one solution nozzle means for supplying a polishing solution containing abrasive material; and at least one supply nozzle means for supplying, simultaneously with supplying of said polishing solution by said solution nozzle means, water containing a dispersion agent so as to form a distribution of polishing solution of different concentrations by diluting said polishing solution with said water containing said dispersion agent on said polishing surface.

5. A polishing apparatus for polishing a surface of an object, said apparatus comprising:

a turntable having a polishing surface against which an object to be polished is to be pressed; and a plurality of radially arranged nozzles for supplying a polishing solution containing abrasive material, of different concentrations differing along a radial direction of said polishing surface.

6. A polishing apparatus for polishing a surface of an object, said apparatus comprising:

a turntable having a polishing surface against which an object to be polished is to be pressed;

at least one solution nozzle for supplying a polishing solution, containing abrasive material, having a common concentration; and a plurality of diluting liquid supply nozzles arranged in a radial direction for supplying adjustable volumes of diluting liquid so as to form a distribution of polishing solution of different concentrations by diluting said polishing solution with said diluting liquid on said polishing surface.

7. A polishing apparatus as claimed in claim 6, wherein said diluting liquid comprises water.

8. A polishing apparatus for polishing a surface of an object, said apparatus comprising:

a turntable having a polishing surface against which an object to be polished is to be pressed;

at least one solution nozzle means for supplying a polishing solution containing abrasive material; and at least one supply nozzle means for supplying, simultaneously with supplying of said polishing solution by said solution nozzle means, water containing a dispersion agent so as to form a distribution of polishing solution of different concentrations by diluting said polishing solution with said water containing said dispersion agent on said polishing surface.

9. A method for polishing a surface of an object, said method comprising:

pressing an object to be polished against a polishing surface of a turntable; and supplying a plurality of different concentrations of a polishing solution containing abrasive material to said polishing surface at a respective plurality of locations spaced radially of said polishing surface.

10. A method as claimed in claim 9, comprising supplying said plurality of different concentrations of polishing solution through a plurality of nozzles positioned at respective said locations.

11. A method for polishing a surface of an object, said method comprising:

pressing an object to be polished against a polishing surface of a turntable;

supplying a polishing solution, containing abrasive material, having a common concentration onto said polishing surface; and supplying a plurality of different volumes of a diluting liquid onto said polishing surface at a respective plurality of locations spaced radially of said polishing surface, and thereby diluting said polishing solution to form a distribution of different concentrations of said polishing solution.

12. A method as claimed in claim 11, comprising supplying said plurality of different volumes of diluting liquid through a plurality of nozzles positioned at respective said locations.

13. A method as claimed in claim 12, comprising adjusting the supply of said diluting liquid through said nozzles, thereby adjusting said distribution.

14. A method for polishing a surface of an object, said method comprising:

pressing an object to be polished against a polishing surface of a turntable;

supplying a polishing solution containing abrasive material onto said polishing surface; and supplying, simultaneously with said supplying of said polishing solution, water containing a dispersion agent onto said polishing surface, and thereby diluting said polishing solution to form a distribution of different concentrations of said polishing solution.

* * * * *